US005681422A

United States Patent [19]

Marschke

[11] Patent Number: 5,681,422

[45] Date of Patent: Oct. 28, 1997

[54] PRESSURE ROLL FOR A SINGLE FACER

[75] Inventor: Carl R. Marschke, Phillips, Wis.

[73] Assignee: Marquip, Inc., Phillips, Wis.

[21] Appl. No.: 621,999

[22] Filed: Mar. 26, 1996

[51] Int. Cl.[6] ..... B31F 1/28

[52] U.S. Cl. ..... 156/472; 156/471; 156/473; 156/205; 156/210; 156/358

[58] Field of Search ..... 156/205, 210, 156/470, 471, 472, 473, 582, 358; 425/369, 336, 368; 264/286; 493/463

[56] References Cited

U.S. PATENT DOCUMENTS

| | | | |
|---|---|---|---|
| 3,919,029 | 11/1975 | Osgood | 156/205 |
| 3,990,935 | 11/1976 | Lehmann | 156/472 |
| 4,086,116 | 4/1978 | Yazaki et al. | 156/205 |
| 4,316,761 | 2/1982 | Hirakawa et al. | 156/472 |
| 4,337,884 | 7/1982 | Hirakawa et al. | 156/472 |
| 4,481,066 | 11/1984 | Hirakawa et al. | 156/472 |
| 5,449,431 | 9/1995 | Isowa | 156/210 |

*Primary Examiner*—Michele K. Yoder

*Attorney, Agent, or Firm*—Andrus, Sceales, Starke & Sawall

[57] ABSTRACT

A single facer apparatus for the production of single face corrugated web includes a pressure roll having a flexible outer surface which is internally biased outwardly to provide the pressure nip for joining the liner and glued corrugated media. A pressure shoe inside the flexible roll is sized and shaped to maintain operative pressure nip contact with at least two corrugating roll flutes. This substantially reduces vibration and noise. The pressure roll is constructed with a substantially enlarged diameter with respect to the corrugating rolls, the single face web joined with a preliminary bond at the pressure nip is wrapped around a substantial portion of the pressure roll circumference downstream of the nip, and the roll is internally heated to cause gelatinization of the glue and to fix the adhesive bond.

11 Claims, 2 Drawing Sheets

PRESSURE ROLL FOR A SINGLE FACER

BACKGROUND OF THE INVENTION

The present invention pertains to an apparatus for forming a single face web of corrugated paperboard and, more particularly, to a pressure roll assembly for use in a single facer.

In the manufacture of corrugated paperboard, a single facet apparatus is used to corrugate the medium web, apply glue to the flute tips on one face thereof, and to bring a liner web into contact with the glued flute tips of the medium web with the application of sufficient heat and pressure to provide an initial bond. A conventional single facet typically includes a pair of fluted corrugating rolls and a pressure roll, which are aligned so the axes of all three rolls are generally coplanar. The medium web is fed between the inter-engaging corrugating rolls and the adhesive is applied to the flute tips by a glue roll while the medium is still on the corrugating roll which comprises the intermediate of the three roll arrangement. The liner web is immediately thereafter brought into contact with the adhesive-coated flute tips in the nip between the pressure roll and the corrugating roll.

As is well known in the art, operative contact between the pressure roll and the corrugating roll at the pressure nip results in vibration and noise as the cylindrical pressure roll passes consecutively from tip to tip of the fluted corrugating roll. The problem is aggravated by higher speeds and by the high pressure used to hold the liner against the fluted medium in the pressure nip. Attempts have been made to eliminate this problem by utilizing stationary pressure members which have an arcuate face corresponding generally to the diameter of the corrugating roll. Such stationary pressure members are shown, for example, in U.S. Pat. Nos. 4,337,884 and 4,481,066. A similar pressure member, but which utilizes instead a belt which moves over the cylindrical surface defined by the flute tips of the corrugating roll, is shown in U.S. Pat. No. 4,316,761. Another approach to reducing the noise generated by contact between the pressure roll and the corrugating roll in a single facer is shown in U.S. Pat. No. 3,919,029. This patent discloses a concave pressure roll mounted on an axis which is skewed with respect to the axis of the corrugating roll so as to maintain constant flute tip contact therewith. U.S. Pat. No. 3,990,935 describes flexure compensated rolls for use as corrugating rolls and a pressure roll in a single facer. However, when applied specifically to the pressure roll, intermittent flute-to-flute contact with the corrugating roll still occurs.

SUMMARY OF THE INVENTION

In accordance with the present invention, a single facer includes a flexible pressure roll which applies a substantially lower nip pressure to the single face web than conventional pressure rolls to provide a preliminary light adhesive bond between the corrugated medium and the liner. The flexible pressure roll has a large diameter surface over a portion of which the single face web is wrapped downstream of the nip. Internal heating of the drum cures the adhesive while the single face web is wrapped thereon.

In accordance with the preferred embodiment, a pressure roll for joining a liner web to a corrugated medium web operates in conjunction with a rotating fluted corrugating roll on which the corrugated medium is carried and comprises a rotatable cylindrical drum which has a flexible outer peripheral surface skin, with the drum mounted to create a pressure nip with the corrugating roll. Means are provided for feeding the liner web into contact with the corrugated medium in the pressure nip, and a pressure shoe is mounted inside the drum and held against rotation therein and biased radially outwardly against the surface skin of the drum at the nip. The pressure shoe has a skin contacting surface which is shaped to operatively bridge the crowns of at least two adjacent corrugating roll flutes.

Preferably, means are provided within the drum to apply a lubricating medium to the interior of the surface skin. Means are also provided for heating the surface skin of the drum. In one embodiment, the heating means comprises a liquid lubricant filling a portion of the drum interior, and a heating device mounted within the drum to heat the lubricant. The heating device preferably comprises a steam heater which is fixed against rotation and immersed in the liquid lubricant.

The assembly includes an axial shaft which extends through and supports the drum for rotation, a pressure shoe support attached to the shaft, and biasing means which interconnect the shoe support and the pressure shoe for providing an outward biasing force to the shoe. In a preferred embodiment, the pressure shoe comprises a plurality of laterally adjacent shoe portions which extend axially across the inside of the drum, the biasing means comprises a pneumatic pressure device for each shoe portion, and control means are provided for selectively varying the pressure applied to each shoe portion.

The assembly may also include a web wrapping roll rotatably mounted adjacent the outer surface of the drum downstream of the nip to hold the liner face of the web in contact with the drum surface. The wrapping roll may also include means for driving the roll to rotate the drum and the single face web being carried thereon. Alternately, the wrapping roll may comprise an idler roll, and the apparatus includes a drive roll mounted downstream of the idler roll to cause the single face web to wrap thereon, the drive roll having its outer surface in engagement with the liner face of the web, and a torque drive for rotatably driving the drive roll to rotate the drum and the single face web carried thereon.

The thickness of the flexible drum surface skin may vary over a relatively high range and, for thinner and more flexible surface skins, means may be provided for creating an internal pressure within the drum greater than normal atmospheric pressure to minimize distortion of the cylindrical drum surface.

DETAILED DESCRIPTION OF THE PREFERRED EMBODIMENT

Figure 1:
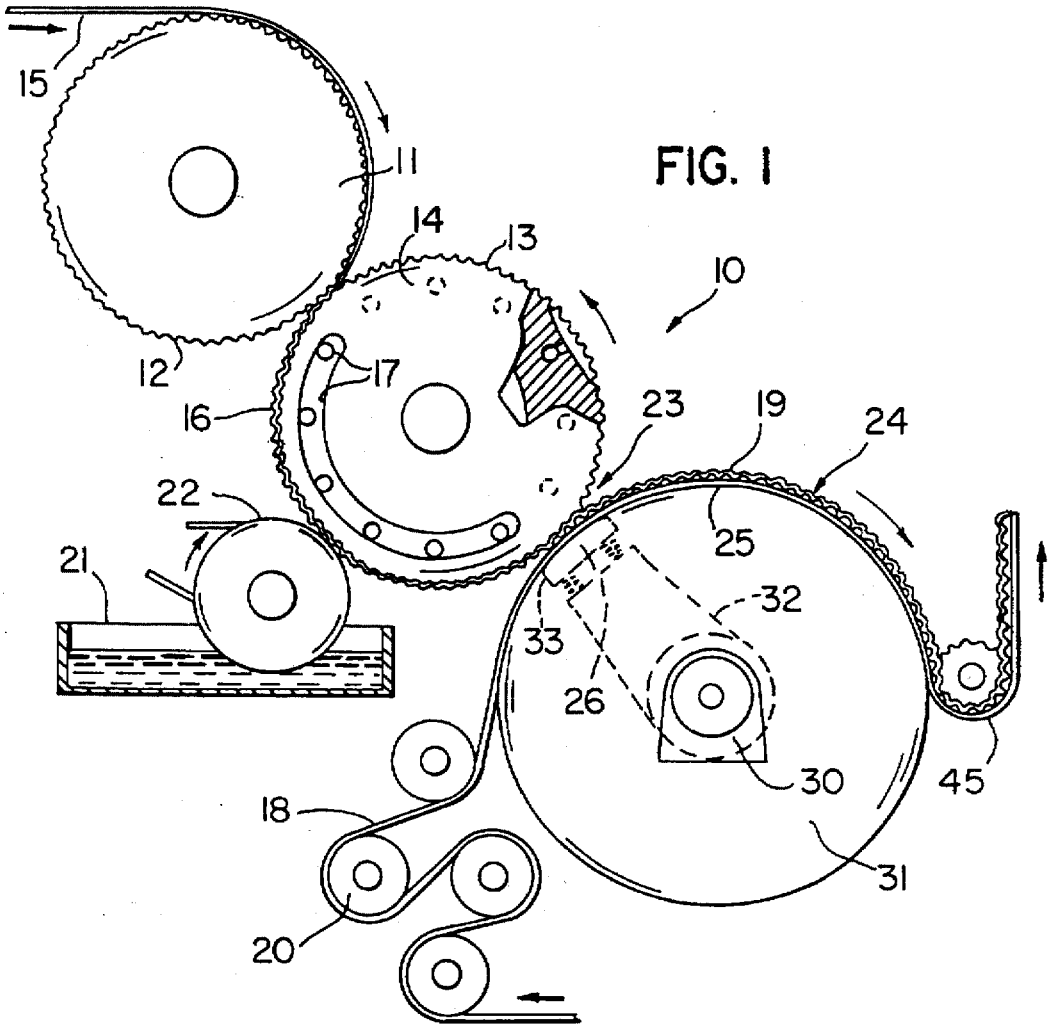
FIG. 1 is a side elevation of a single facer including the flexible pressure roll of the subject invention.
Figure 2:
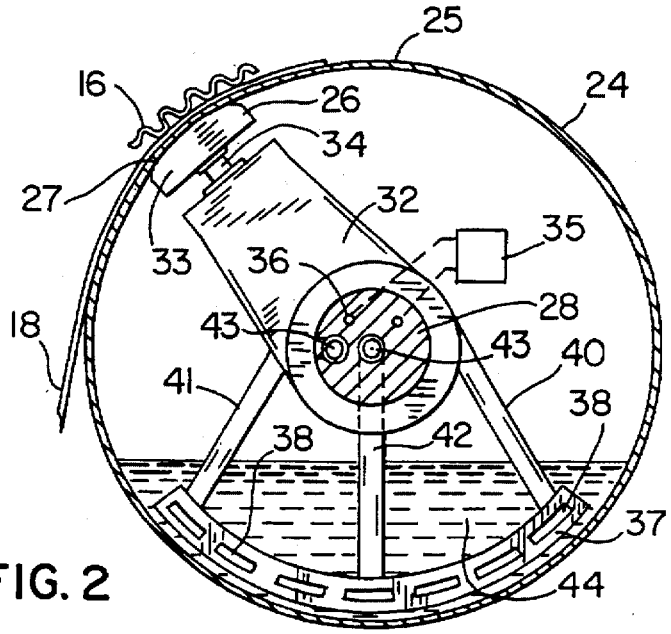
FIG. 2 is an enlarged vertical section through the pressure roll shown in FIG. 1.
Figure 3:
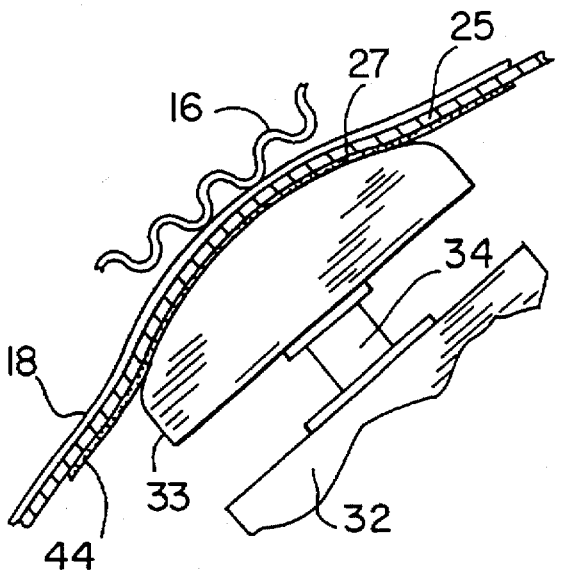
FIG. 3 is an enlarged detail of a portion of the roll and pressure shoe shown in FIG. 2.
Figure 4:
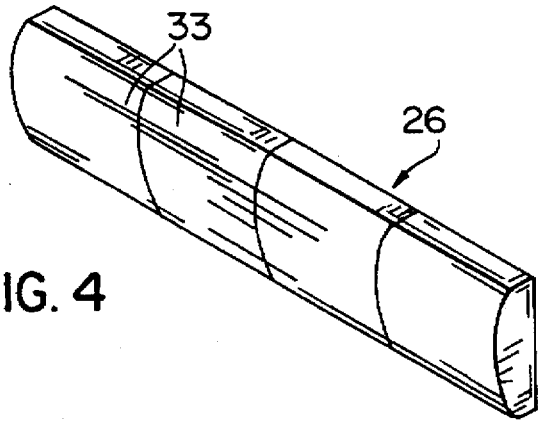
FIG. 4 is a perspective view of an arrangement of pressure shoe sections of the type shown in FIGS. 1–3.

Referring initially to FIG. 1, a conventional prior art single facer typically includes a pair of corrugating rolls normally arranged with an upper corrugating roll 11 having a toothed or fluted surface in engagement with a similar fluted surface 13 of a lower corrugating roll 14. The fluted surfaces 12 and 13 of the respective rolls 11 and 14 define similarly shaped teeth of identical pitch which are chosen to provide the desired flute size in the corrugated medium. The flutes are formed by passing a medium web 15 between the inter-engaging flutes of the counterrotating corrugating rolls.

As is known in the art, one or both corrugating rolls 12 and 14 may be internally heated, as with steam, to preheat the corrugated medium 16 to enhance the curing of the subsequently applied adhesive. As is also known in the prior art, the lower corrugating roll 14 may be provided with vacuum passages 17 communicating with the roots of the flute teeth to hold the corrugated medium in position on the surface of the corrugating roll until the liner web 18 is joined to it, as will be described.

A paper liner web 18 is pulled from an upstream source roll for feeding into the single facer, such as by passage around a series of driven high friction rolls 20. A suitable adhesive, typically a starch-based glue, is applied directly to the flute tips of the corrugated medium 16 via direct contact from a glue roll 22 of a glue machine 21. The glued corrugated medium 16 and the liner web 18 are joined in a pressure nip 23 created by the rotating contact between the lower corrugating roll 14 and a pressure roll 24 which is the subject of the present invention.

In the corrugated paperboard industry, four conventional flute configurations are utilized. Each flute configuration varies from the others in terms of pitch dimension or number of flutes per foot and flute depth. The configurations range from A-flute having 33 to 35 flutes per foot and a flute depth of 0.185 inch to E-flute having 90 to 96 flutes per foot and a flute depth of 0.045 inch. Thus, the flute pitch dimension ranges from about ⅓ inch (approximately 8 mm) in A-flute to about ⅛ inch (about 3 mm) in E-flute.

In prior art single facers which typically utilize a rigid cylindrical pressure roll, counterrotating contact between the pressure roll and the lower corrugating roll results in a characteristic interrupted contact between the smooth cylindrical pressure roll surface and each succeeding flute tip on the lower corrugating roll (with the 2-ply single face web of course captured therebetween). This intermittent contact is the source of significant vibration and extremely high noise levels. In addition, the high nip pressure typically applied in conventional single facers simply aggravates the vibration and noise problems.

The pressure roll 24 of the present invention comprises a relatively large diameter roll which is nominally cylindrical, but is provided with a flexible outer peripheral surface skin 25 which coacts with an internal pressure shoe 26 to deform and create a pressure nip surface which operatively contacts at least two flutes on the lower corrugating roll 14. In order to assure such contact over the full range of standard flute sizes, the pressure shoe 26 must be shaped to provide a contact length in the machine direction (direction of roll rotation) of at least about ⅓ inch. Preferably, a contact surface length slightly in excess of that dimension is utilized. The pressure surface in the machine direction, therefore, may be chosen to be about ⅜ inch (about 1 cm). In order to adequately span the maximum flute tip-to-flute tip distance, the contact surface portion 27 of the pressure shoe must necessarily have a substantially larger radius of curvature in the machine direction than the nominal radius of the pressure roll 24. The pressure shoe 26 is biased into contact with the flexible skin 25 of the pressure roll with a force sufficient to cause a flattening of the skin adequate to operatively bridge the crowns of at least two adjacent flute tips at all times.

The pressure roll 24 is mounted for rotation on a stationary axial shaft 28 by bearings 30 carried in the roll end walls 31. A pressure shoe support 32 is attached to the shaft 28 in a fixed position within the pressure roll interior to provide biasing support for the pressure shoe 26. Preferably, the pressure shoe comprises a series of laterally adjacent shoe portions 33 extending axially in the cross machine direction to provide a span sufficient to match the corrugating roll width and the width of the webs being processed. Each shoe portion 33 is mounted on the pressure shoe support 32 with means to provide a radially outward biasing force sufficient to provide the desired pressure at the nip 23. The biasing means may be simple compression springs, but preferably comprise individual pneumatic cylinders 34 for each shoe portion 33. Each cylinder 34 is provided with a controllable source of pneumatic pressure to selectively vary the pressure applied to each shoe portion 33 and, thus, the force applied to the freshly glued single face web at the pressure nip 23. A pressure control means 35 is operative to apply pneumatic pressure only to those cylinders 34 biasing the shoe portions 33 sufficient to span the width of the web being processed. In this manner, direct contact between the flexible skin 25 of the pressure roll and the fluted surface 13 of the lower corrugating roll 14 is minimized or eliminated. Pneumatic pressure may be supplied, via the control 35, from a compressed air source (not shown) outside the drum via axial air passages 36 in the shaft 28.

The nominal outside diameter of the pressure roll 24 is preferably large compared to the diameters of the corrugating rolls, but may vary over a substantially large range. For example, pressure roll diameters in the range of 2.5 to 4 feet (0.75 to 1.2 m) are believed to be fully adequate. Similarly, the thickness of the deformable skin 25 on the pressure roll may vary over a wide range from, for example, 0.030 to 0.125 inch (about 75 to 3.2 mm). The flexibility of the pressure roll outer skin 25 will of course depend significantly on the thickness thereof. Steel is the preferred material for the flexible skin, but other metals may also be utilized. The internal support pressure biasing the shoe portions 33 into contact with the inner surface of the flexible skin 25 may be varied considerably depending upon the thickness of the skin and the desired nip load. Actual contact pressure in the range of 50 to 200 psi (345 to 1380 kPa) is believed to be adequate, although other pressures outside this range may also be fully suitable. However, the nip pressure is just sufficient to provide an initial bond, as will be discussed below.

The pressure roll 24 also incorporates means to reduce the sliding friction between the inside of the flexible roll skin 25 and the pressure shoe 26 and, simultaneously, to heat the skin to provide means to heat the single face web and enhance the curing of the adhesive. A steam heater 37 is mounted within the pressure roll 24. The heater 37 preferably includes a semicylindrical network of steam tubes 38 secured by a supporting frame 40 to the axial shaft 28 in a manner fixed with respect to rotation of the pressure roll 24. The supporting frame 40 includes steam supply lines 41 and a condensate return line 42, all of which are provided communication with the outside via axial steam passages 43 in the shaft 28. As is best seen in FIG. 1, the steam heater occupies only the lower portion of the pressure roll interior and is covered by a supply of oil 44 or other suitable liquid lubricant, preferably to a level just covering the steam heater 37. The oil is heated by the steam and rotation of the pressure roll 24 on the axial shaft 28 uniformly heats the flexible roll skin 25 and distributes the oil over the inside surface of the skin to provide lubrication for the contact surfaces of the pressure shoe 26 and the skin 25.

Figure 5:
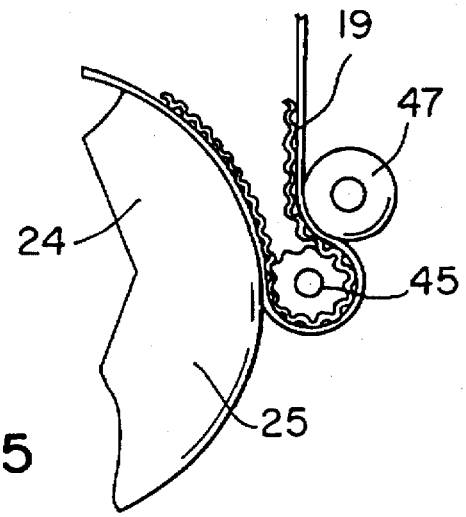
FIG. 5 is a segmental view of a portion of FIG. 1 showing an alternate web drive arrangement.

An important aspect of the present invention is to utilize relatively low pressure in the pressure nip 23 to provide a light initial bond between the corrugated medium 16 and the liner web 18 and to wrap the resulting single face web 19 on a portion of the face of the heated pressure roll 24 downstream of the nip. Contact with the heated drum will cause the adhesive to gelatinize and provide the final permanent bond. The downstream wrap of the single face web 19 on the pressure roll 24 is effected by a wrapping roll 45 mounted adjacent the outer surface of the drum and positioned to hold the liner face of the single face web in contact with the outer roll skin 25. Preferably, the wrapping roll 45 is mounted on an adjustable wrap arm so the amount of wrap may be selectively varied. The wrapping roll 45 may be driven by a suitable torque drive to maintain tension and adequate heat transfer contact between the web and the flexible surface. The wrapping roll 45 includes a suitable toothed or fluted surface corresponding to the flute size provided by the corrugating rolls 11 and 14. Alternately, as shown in FIG. 5, the wrapping roll 45 may be an idler roll with the web driven by a separate drive roll 47 in contact with the liner face of the single face web downstream of the wrapping roll.

In order to prevent or minimize possibly undesirable deformation of the flexible skin 25 resulting from wrapping tension downstream of the pressure shoe 26, the interior of the drum may be pressurized to a low internal pressure. It is believed that an internal pressure of just a few psi above atmospheric pressure is sufficient. If internal pressurization is desired, the pressure may be supplied from an external source through suitable passages in the axial shaft 28, generally in a manner previously described.

I claim:

1. A pressure roll assembly for joining a liner web to a corrugated medium web being carried on a rotating fluted corrugating roll in a single facer apparatus to form a single face web, said assembly comprising:

a rotatable cylindrical drum having a flexible outer peripheral surface skin rotatable with the drum, said drum mounted to create a pressure nip with the corrugating roll;

means for feeding the liner web into contact with the corrugated medium in the pressure nip;

a pressure shoe mounted against rotation within the drum and biased radially outwardly against the surface skin at the nip, said shoe having a convex skin connecting surface shaped to deform the surface skin and cause said skin to operatively bridge the crowns of at least two adjacent corrugating roll flutes;

means for heating the surface skin of the drum; and, a web wrapping roll rotatably mounted adjacent the outer surface of the drum downstream of the nip to hold the liner of the single face web in the contact with the drum surface.

2. The assembly as set forth in claim 1 including a lubricating medium applied to the interior of the surface skin.

3. The assembly as set forth in claim 1 wherein said heating means comprises:

a liquid lubricant filling a portion of the drum interior; and, a heating device mounted within the drum to heat the lubricant.

4. The assembly as set forth in claim 3 wherein said heating device comprises a steam heater fixed against rotation and immersed in the liquid lubricant.

5. The assembly as set forth in claim 1 including an axial shaft extending through and supporting the drum for rotation;

a pressure shoe support attached to the shaft; and, biasing means interconnecting the shoe support and the pressure shoe for providing an outward biasing force to said shoe.

6. The assembly as set forth in claim 5 wherein said pressure shoe comprises a plurality of laterally adjacent shoe portions extending axially across the inside of the drum;

said biasing means comprises a pneumatic pressure device for each shoe portion; and, control means for said pressure devices to selectively vary the pressure applied to each shoe portion.

7. The assembly as set forth in claim 1 including means for driving the wrapping roll to rotate the drum and single face web therewith.

8. The assembly as set forth in claim 1 wherein said wrapping roll is an idler roll, and including a drive roll mounted downstream of said idler roll to cause the single face web to wrap thereon, said drive roll having its outer surface in engagement with the liner face of the web; and, a torque drive for rotatably driving said drive roll to rotate the drum and single face web therewith.

9. The assembly as set forth in claim 1 including means for creating an internal pressure within the drum greater than ambient atmospheric pressure.

10. The assembly as set forth in claim 1 wherein said pressure shoe surface has a diameter greater than the nominal diameter of the cylindrical drum.

11. The assembly as set forth in claim 1 wherein said pressure shoe comprises a plurality of laterally adjacent shoe portions extending axially across the inside of the drum;

biasing means for providing an outward biasing force to each of said shoe portions; and, control means to selectively vary the force applied to each shoe portion.

* * * * *